US008746519B2

(12) United States Patent
Young et al.

(10) Patent No.: US 8,746,519 B2
(45) Date of Patent: Jun. 10, 2014

(54) RELEASABLE ATTACHMENT APPARATUS

(75) Inventors: Stanfield Young, Los Alamitos, CA (US); Boake Paugh, Rancho Cucamonga, CA (US)

(73) Assignee: West Coast Chain Mfg. Co., Ontario, CA (US)

( * ) Notice: Subject to any disclaimer, the term of this patent is extended or adjusted under 35 U.S.C. 154(b) by 801 days.

(21) Appl. No.: 12/688,704

(22) Filed: Jan. 15, 2010

(65) Prior Publication Data

US 2011/0174852 A1 Jul. 21, 2011

(51) Int. Cl.
*A45F 5/00* (2006.01)

(52) U.S. Cl.
USPC ..... 224/162; 224/269

(58) Field of Classification Search
USPC ..... 224/162, 269, 666; 242/380, 382, 385, 242/379
See application file for complete search history.

(56) References Cited

U.S. PATENT DOCUMENTS

| | | | | |
|---|---|---|---|---|
| 2,599,660 | A | 6/1952 | Poutinen | |
| 3,450,369 | A | 6/1969 | Blanch et al. | |
| 3,834,645 | A | 9/1974 | Morishige | |
| 3,968,670 | A | 7/1976 | Quenot | |
| 4,373,824 | A | 2/1983 | Olsen | |
| 4,417,703 | A | 11/1983 | Weinhold | |
| 4,596,365 | A | 6/1986 | Wang | |
| 4,854,522 | A | 8/1989 | Brown et al. | |
| D309,373 | S | 7/1990 | Appelbaum | |
| 4,946,010 | A | 8/1990 | DiBono | |
| 5,174,625 | A | 12/1992 | Gothier et al. | |
| 5,265,823 | A | 11/1993 | Doty | |
| 5,400,521 | A * | 3/1995 | Waldherr | 33/767 |
| 5,400,625 | A | 3/1995 | Embry | |
| 5,509,616 | A * | 4/1996 | Millen et al. | 242/381.5 |

(Continued)

FOREIGN PATENT DOCUMENTS

| | | |
|---|---|---|
| JP | 60-74685 | 5/1985 |
| JP | 1-96480 | 6/1989 |

(Continued)

OTHER PUBLICATIONS

International Search Report dated Mar. 29, 2011 for International Application PCT/US11/21398, 3 sheets.

(Continued)

*Primary Examiner* — Justin Larson
*Assistant Examiner* — Lester L Vanterpool
(74) *Attorney, Agent, or Firm* — Christie, Parker & Hale, LLP

(57) ABSTRACT

A releasable attachment apparatus has multiple components that allow for easy storage, deployment and detachment of small portable items carried on the apparatus. In one embodiment, the apparatus has a retractable unit having a housing inside of which are a reel, a spring coil biasing rotation of the reel, and a tensile member carried on the reel. The housing has a female opening that fittingly receives a connector so that there is minimal swivel action in the connector and thus minimal strain on the tensile member when the tensile member is fully retracted in drawing the connector to a stored configuration with the retractable unit. The apparatus also includes a fastener that is adapted to carry the small portable items and is removably attached to the connector. The apparatus also includes a locking switch which is movable between a neutral position that allows rotation of the reel and a locking position which locks the reel against rotation.

20 Claims, 9 Drawing Sheets

(56) References Cited

U.S. PATENT DOCUMENTS

| | | | | |
|---|---|---|---|---|
| 5,513,785 | A * | 5/1996 | Campagna, Jr. | 224/162 |
| 5,535,960 | A | 7/1996 | Skowronski et al. | |
| 5,645,239 | A | 7/1997 | Zwayer et al. | |
| 5,697,572 | A | 12/1997 | Salentine et al. | |
| 5,898,472 | A | 4/1999 | Oshikawa | |
| 5,954,288 | A | 9/1999 | Shih | |
| 6,019,198 | A | 2/2000 | Nielsen | |
| 6,019,304 | A | 2/2000 | Skowronski et al. | |
| 6,152,395 | A | 11/2000 | Corriveau et al. | |
| 6,179,238 | B1 | 1/2001 | Phillipps | |
| 6,199,784 | B1 | 3/2001 | Wang et al. | |
| 6,199,785 | B1 * | 3/2001 | Paugh | 242/385.4 |
| 6,250,578 | B1 | 6/2001 | Manda | |
| 6,279,682 | B1 | 8/2001 | Feathers | |
| 6,293,485 | B1 | 9/2001 | Hollowed | |
| 6,324,285 | B1 | 11/2001 | Dowsett et al. | |
| 6,325,665 | B1 | 12/2001 | Chung | |
| 6,336,607 | B1 | 1/2002 | Perrier | |
| 6,439,490 | B1 | 8/2002 | Hwang | |
| 6,536,697 | B2 | 3/2003 | Tsan | |
| 6,591,461 | B2 | 7/2003 | Salentine et al. | |
| 6,616,080 | B1 | 9/2003 | Edwards et al. | |
| 6,668,608 | B1 | 12/2003 | Derman | |
| 6,679,448 | B1 | 1/2004 | Carpenter et al. | |
| 6,694,922 | B2 | 2/2004 | Walter et al. | |
| 6,808,138 | B2 * | 10/2004 | Liao | 242/378.1 |
| 6,921,040 | B2 | 7/2005 | Watari | |
| 7,007,882 | B2 * | 3/2006 | Raia et al. | 242/379 |
| 7,374,123 | B2 * | 5/2008 | Han | 242/385.2 |
| 7,755,483 | B2 * | 7/2010 | Schmidt | 340/568.1 |
| 8,191,815 | B2 * | 6/2012 | Huang | 242/379 |
| 2001/0035242 | A1 | 11/2001 | Hughs et al. | |
| 2003/0042348 | A1 * | 3/2003 | Salentine et al. | 242/380 |
| 2003/0042648 | A1 * | 3/2003 | Tsai | 264/161 |
| 2004/0032741 | A1 * | 2/2004 | Tai | 362/387 |
| 2005/0011982 | A1 * | 1/2005 | Salentine et al. | 242/379.2 |
| 2007/0278265 | A1 | 12/2007 | Contente | |
| 2008/0042000 | A1 | 2/2008 | Horton | |
| 2008/0283651 | A1 | 11/2008 | Ito et al. | |

FOREIGN PATENT DOCUMENTS

| | | |
|---|---|---|
| JP | H06-52542 | 7/1994 |
| JP | 3060248 | 5/1999 |
| JP | 2008-288960 | 11/2008 |

OTHER PUBLICATIONS

Office Action in Japan Application No. 2012-549139 dated Jan. 7, 2014 (Translated).

* cited by examiner

RELEASABLE ATTACHMENT APPARATUS

FIELD OF INVENTION

The present invention relates to quick release connectors that can be carried on a person's body, in particular, quick release connectors adapted for tethering small items, such as tools, gear, small electronic devices, badges and the like.

BACKGROUND OF INVENTION

Apparatus with releasable attachment are known, especially those for personal use in carrying small portable items such as keys, badges, gear, whistles and small tools. Hanging such items on a ring attached to a distal end of a cable, chain, cord, or monofilament and the like (collectively herein referred to as a "tensile member"), wound on a retractable reel is also known where such reel is contained in a housing that can be clipped to a belt or waistband. While the retractable reel conveniently allows the tensile member to be extended when items are in use and retracted when such use is completed, the tensile member can be one of the first components that suffers strain and fatigue, especially at the location of attachment to the ring on which the items are hung. In particular, swivel action of the items such as when tensile member is retracted and/or when the user of the apparatus is walking wears down the tensile member at the location of attachment. Thus while the majority of the apparatus may be in good working condition, the tensile member is prematurely worn to a stage where the ring and the items thereon can easily detach completely from the apparatus.

Locking mechanisms that control the rotation of retractable reels are also known. Locking mechanisms are often used with retractable tape measures. However, such locking mechanisms can be complicated with multiple moving parts, thus increasing the cost of manufacture, the risk of malfunction and breakage and/or the overall weight and size.

Helical metal rings are commonly provided on key chains as a means by which keys and other small portable items can be removably attached. While such rings securely attach the keys or other small portable items, dexterity and strength are often required in order for a user to pry open the rings. Moreover, the helical configuration of the rings does not allow certain items to slide on or off easily.

Accordingly, it is desirable that a releasable attachment apparatus provide an attachment that minimizes, if not eliminates, swivel motion between the items attached and the housing, so as to minimize wear and tear on the tensile member. Moreover, it is desirable that the releasable attachment apparatus provide a locking mechanism with a simple design that uses a minimal number of components to reduce cost of manufacturing, the risk of malfunction and/or the overall size and weight. Furthermore, it is desirable that the releasable attachment apparatus provides a means by which items can be readily attached and detached in a secured manner.

SUMMARY OF THE INVENTION

The present invention is directed to a portable releasable attachment apparatus for personal use having multiple components that allow for easy storage, deployment and detachment of small items carried on the apparatus. In one embodiment, the apparatus has a retractable unit having a housing inside of which are a reel, a spring coil biasing rotation of the reel, and a tensile member carried on the reel. In accordance with a feature of the present invention, the housing has a female opening in which a connector can dock so that there is minimal swivel action in the connector and thus minimal strain on the tensile member when the tensile member is fully retracted in drawing the connector to a stored configuration with the retractable unit. The apparatus also includes a fastener that is adapted to carry the small portable items and is removably attached to the connector. The apparatus also includes a locking switch which is movable between a neutral position that allows rotation of the reel and a locking position which locks the reel against rotation.

In a more detailed embodiment, the switch interacts with a locking cam adapted to move a ratchet of the switch into locking contact with the reel to lock the reel against rotation, and a release cam adapted to move the ratchet out of contact with the reel. Also in a more detailed embodiment, the fastener includes a U-shaped member having at least one end adapted for releasable engagement with the fastener, wherein the end is secured against release unless the fastener is detached from the connector.

The present invention is also directed to an embodiment of a releasable attachment apparatus where the connector member and/or the fastener is configured to adopt a stored configuration and a deployed configuration, and where the fastener is configured to further adopt a detached configuration whether the connector is stored or deployed.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF THE INVENTION

Figure 1:
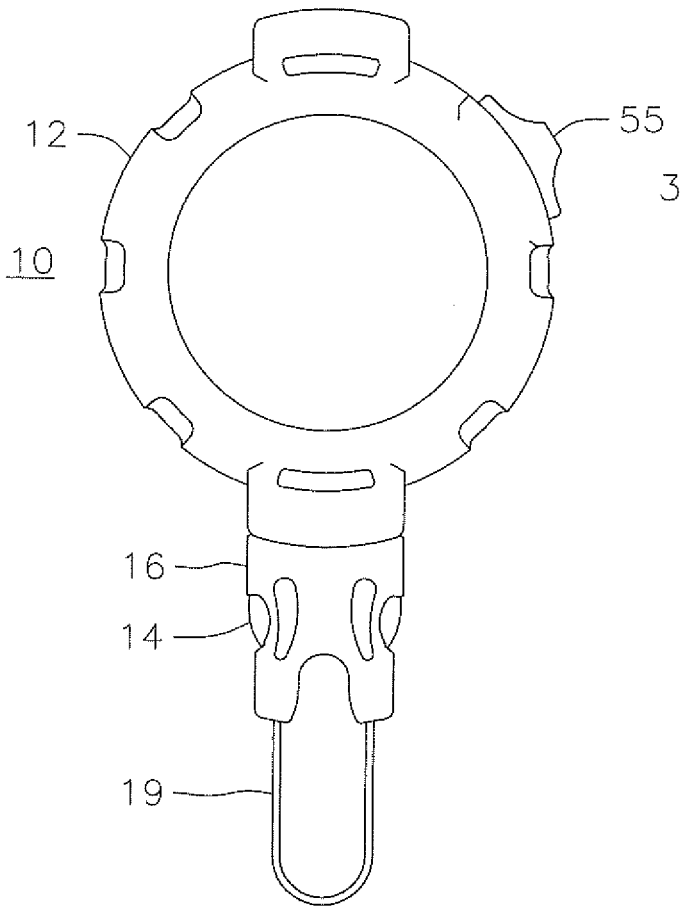
FIG. 1 is a front view of one embodiment of a releasable attachment apparatus in accordance with the present invention.
Figure 2:
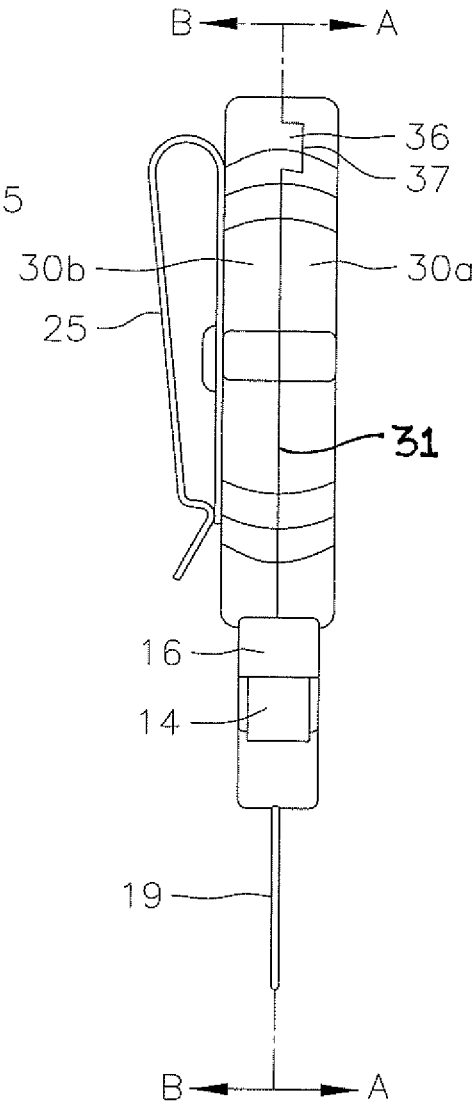
FIG. 2 is a side elevational view of the apparatus of claim 1.
Figure 1A:
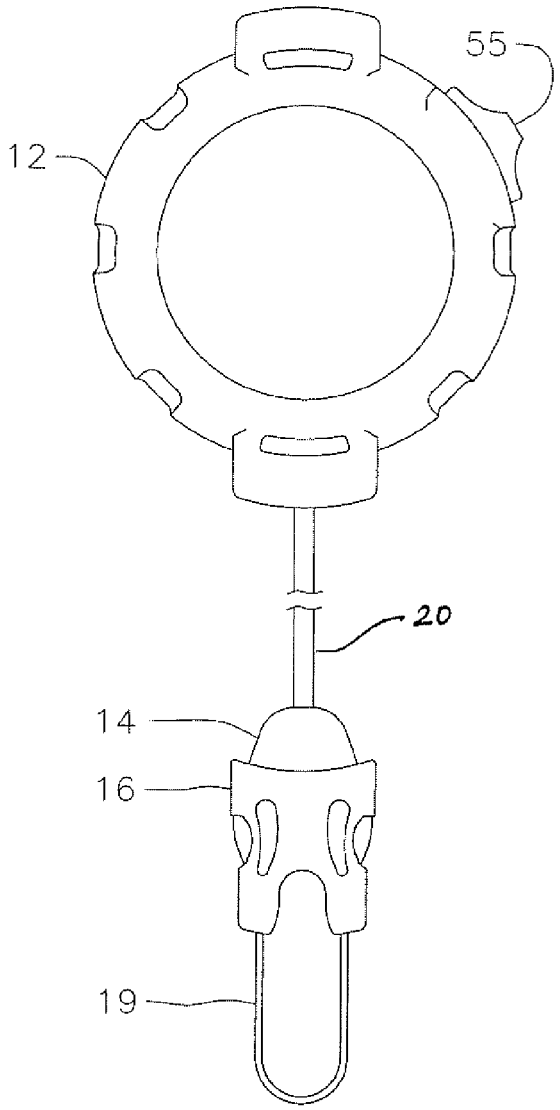
FIG. 1A is a front view of the apparatus of FIG. 1 in a deployed configuration.
Figure 1B:
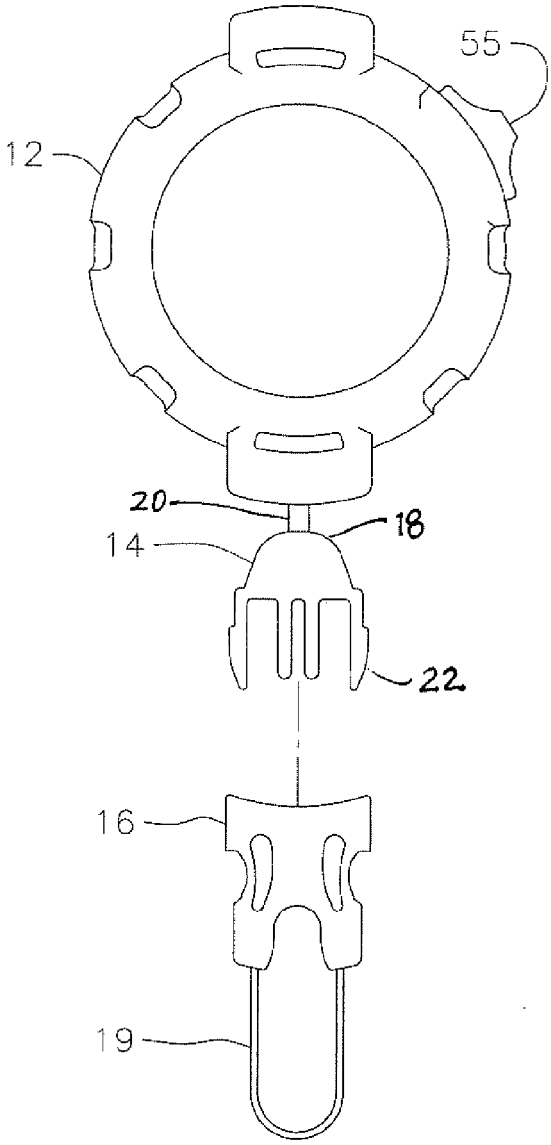
FIG. 1B is a front view of the apparatus of FIG. 1 in a deployed and detached configuration.
Figure 1C:
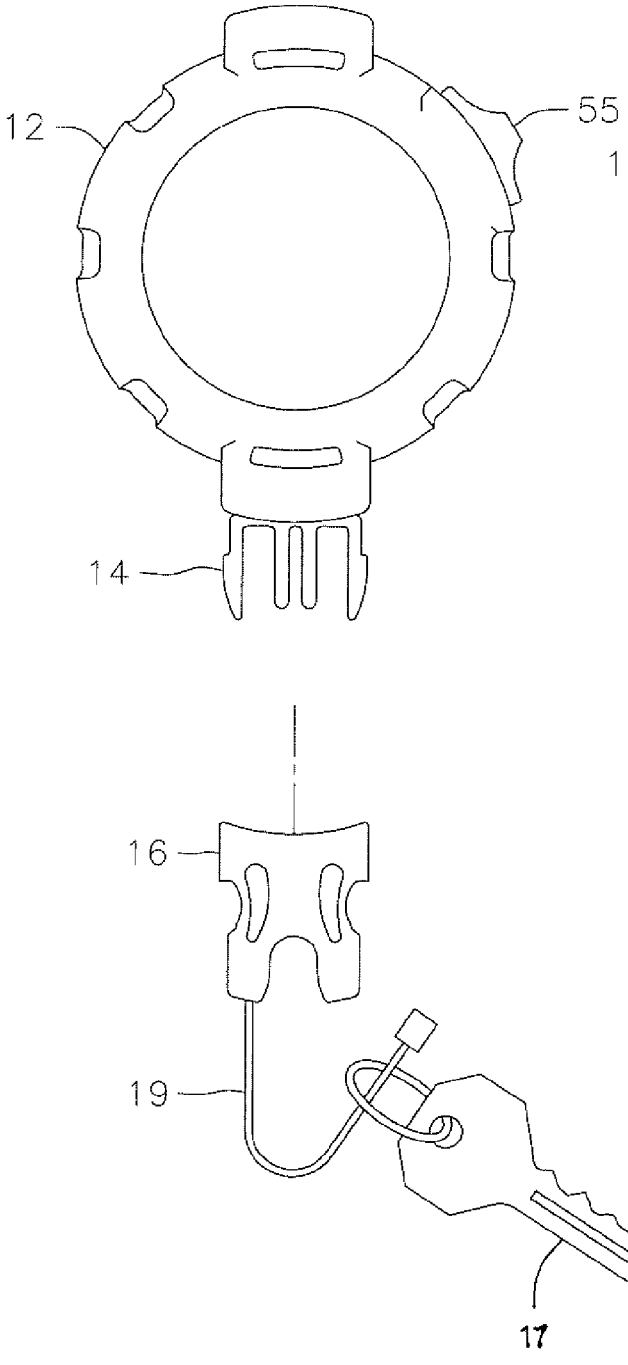
FIG. 1C is a front view of the apparatus of FIG. 1 with a connector in a stored configuration, a fastener in a deployed/detached configuration and a dual connector in a open configuration.

FIGS. 1, 1A, 1B, 1C and 2 illustrate an embodiment of a releasable attachment apparatus 10 with multiple components that are releasable, separable and/or detachable from each other. The apparatus 10 has a retraction unit 12, a connector 14 and a fastener 16 for a device 17 (FIG. 1C), for example, a key, a small tool or gear, a badge, and the like. In fact, the apparatus has an overall shape that resembles a key with a circular portion and an elongated portion. At its proximal end 18, the connector 14 is tethered to a tensile member 20 dispensed from the retraction unit. At its distal end 22, the connector 14 is adapted for releasable coupling to the fastener 16. Advantageously, by means of a retractable reel housed in the retraction unit 12, the connector 14 along with the fastener 16 can readily assume a stored configuration relative to the retraction unit (FIG. 1), and a deployed configuration remote from but remaining tethered to the retraction unit (FIG. 1A). Further, by means of releasable coupling with the connector 14, the fastener 16 can readily assume a detached configuration remote from the connector 14 whether the connector is deployed (FIG. 1B) or stored (FIG. 1C). Moreover, the fastener 16 includes an attachment member 19 which can be closed (FIG. 1B), open (FIG. 1C) or fully detached (FIG. 1D) from the fastener 16. In accordance with the present invention, the connector 14 is adapted to minimize, if not prevent, swivel motion of the connector when it is in the stored configuration, which swivel motion would otherwise prematurely weaken the tensile member 20 at the location of attachment to the connector. Moreover, as a safety feature, the attachment member 19 can be released only when the fastener 16 is detached from the connector 14. Furthermore, a switch 55 on the retraction unit 12 enables a user to lock and unlock the deployment and extension of the tensile member 20 from the retractor unit 12. The retraction unit 12 can be carried on a belt, for example, by means of a clip 25 affixed to a housing 30, as shown in FIG. 2.

Figure 3A:
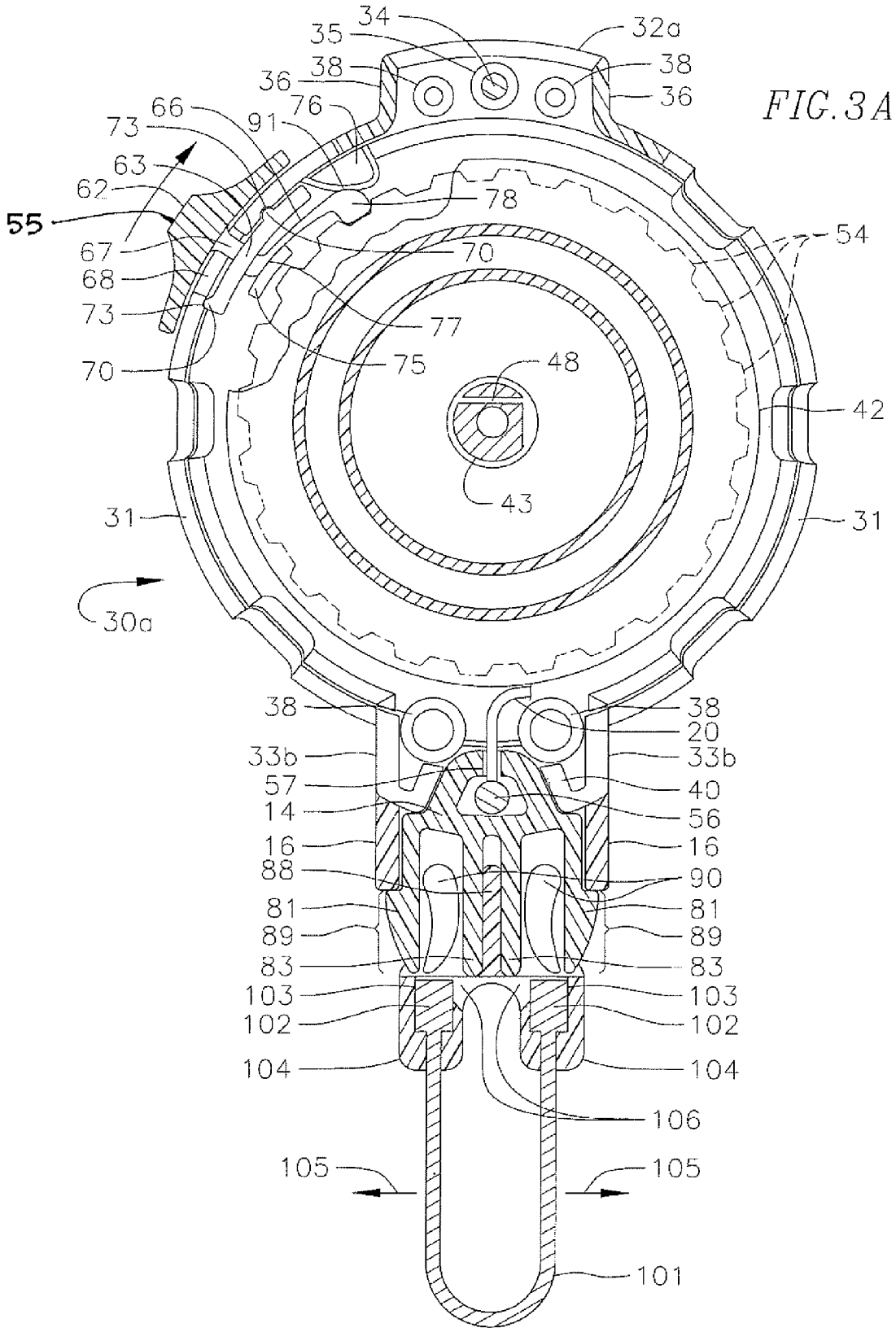
FIG. 3A is a cross-sectional view of the apparatus of FIG. 1, with a switch in a locking position, taken along line A-A.
Figure 3B:
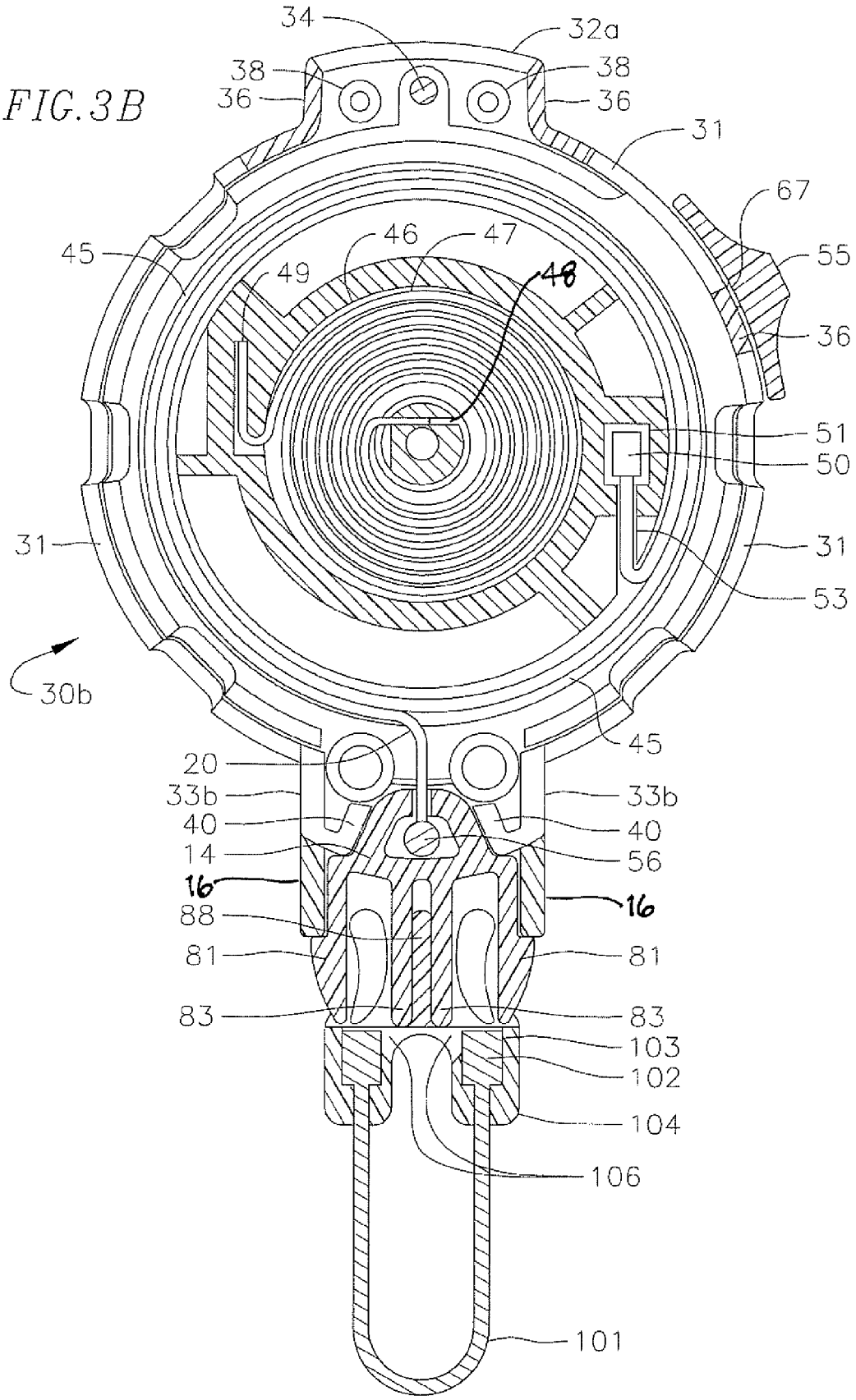
FIG. 3B is a cross-sectional view of the apparatus of FIG. 1, with a switch in a locking position, taken along line B-B.

The housing has a generally circular cross section and thus an outer circumference as seen in FIG. 1, with a generally planar profile as seen in FIG. 2, and is formed of two, generally similar housing halves 30*a* and 30*b* as shown in FIGS. 3A and 3B. The housing halves are configured to contact each other along a generally circular periphery edge 31 (FIG. 2). Extending outwardly at the top and the bottom of the periphery edge of each housing half and lying in the planar profile of the housing are portions 32 and 33. Top portion 32*b* of the second housing half 30*b* has an alignment prong 34 extending perpendicularly to the planar profile toward the first housing half 30*a*. The prong 34 is received in a recess 35 formed in the top portion 32*a* of the first housing half 30*a*. The top portion 32*b* also has a pair of opposing periphery edge projections 36 (see also FIG. 2) extending toward the first housing half 30*a* that are received in recesses 37 formed in the periphery edge 31 of the first housing half 30*a*. Also in each of the top portions 32*a* and 32*b* are corresponding and aligned through-holes 38 adapted to receive screws (not shown) to releasably fasten the housing halves 30*a* and 30*b* together.

Bottom portions 33*a* and 33*b* of the housing halves 30*a* and 30*b* also have corresponding and aligned through-holes 38 adapted to receive screws to releasably fasten the housing halves 30*a* and 30*b* together. In accordance with a feature of the present invention, each of the bottom portions 33*a* and 33*b* has a recess formations 40 which jointly form a cradle or docking station. With a concave formation with an outwardly-facing opening, the cradle conformingly receives the correspondingly-shaped, if not similarly-shaped, proximal end 18 of the connector 14 which can nest fittingly in the cradle when the connector is in the stored configuration, as when the tensile member 20 is fully retracted.

The tensile member 20 is wound on a reel 42 adapted to rotate about a central axis member 43 projecting perpendicularly from the second housing half 30*b* toward the first housing half 30*a*. The reel 42 has a first side that faces the first housing half and a second side that faces the second housing half. Between the first side and the second side is a circumferential channel 45 (FIG. 3B) in which the tensile member 20 is wound. Facing the second housing half is an inner annular space 46 surrounding the axis 43 in which a spring coil 47 sits to bias the reel 42 to rotate in a direction that wounds the tensile member 20 in the channel 45 and retracts the tensile member. An inner end of the coil 47 is anchored in a slot 48 in the axis 43. An outer end of the coil 47 is anchored in a slot 49 formed in the reel 42. An inner end of the tensile member 20 is anchored in an end cap 50 that sits in a recess 51 formed in the reel 42 on second side facing the second housing half 30*b*. A cutout 53 is formed in the second side of the reel to allow the tensile member 20 access to the channel 45. In FIG. 3A, on the first side of the reel facing the first housing half are a plurality of circumferential cogs 54 which interact with the switch 55, as explained further below.

The tensile member 20 (e.g., a cable, chain, cord or monofilament) unwinds from the reel 42 and extends outside of the retraction unit 12 when its distal end is pulled with a sufficient force to overcome the biasing retraction force of the spring coil 47. When the distal end is released, the tensile member 20 rewinds on the reel 42 under the force of the spring coil 47. With reference to FIGS. 3A, 3B, 5 and 6, the distal end of the tensile member is fixed in a fitting 56, such as a bearing, which extends outside of the housing 30 via the opening defined by the cradle 40. The fitting 56 is anchored in the male proximal end 18 of the connector 14, with the tensile member 20 passing through a central passage 57 formed in the connector. The passage 57 has a stop junction 58 between a wider passage and a narrow passage which the fitting 56 cannot pass and thus retains the connector 14 on the tensile member 20. The male proximal end 18 of the connector 14 is drawn into the female cradle 40 via its opening when the tensile member 20 is fully retracted on the reel 42. A close fitting between the male proximal end 18 and the female cradle 40 advantageously prevents swivel motion of the connector 14 relative to the housing 30 which would otherwise cause premature wear and tear on the tensile member 20 at or near the location of attachment to the connector. In the illustrated embodiment, the female and male formations 18 and 40 are wedge-shaped or tapered (e.g., trapezoidal), having a wider distal lateral dimension and a narrower proximal lateral dimension (FIGS. 3A, 3B and 6), and both having a generally rectangular cross-section in one embodiment (FIG. 7). Once received in the female formation 40 and maintained in there under positive tension of the spring coil 47 acting on the retraction reel 42, the male proximal end 18 minimizes motion of the connector 14 relative to the housing 30.

Figure 4:
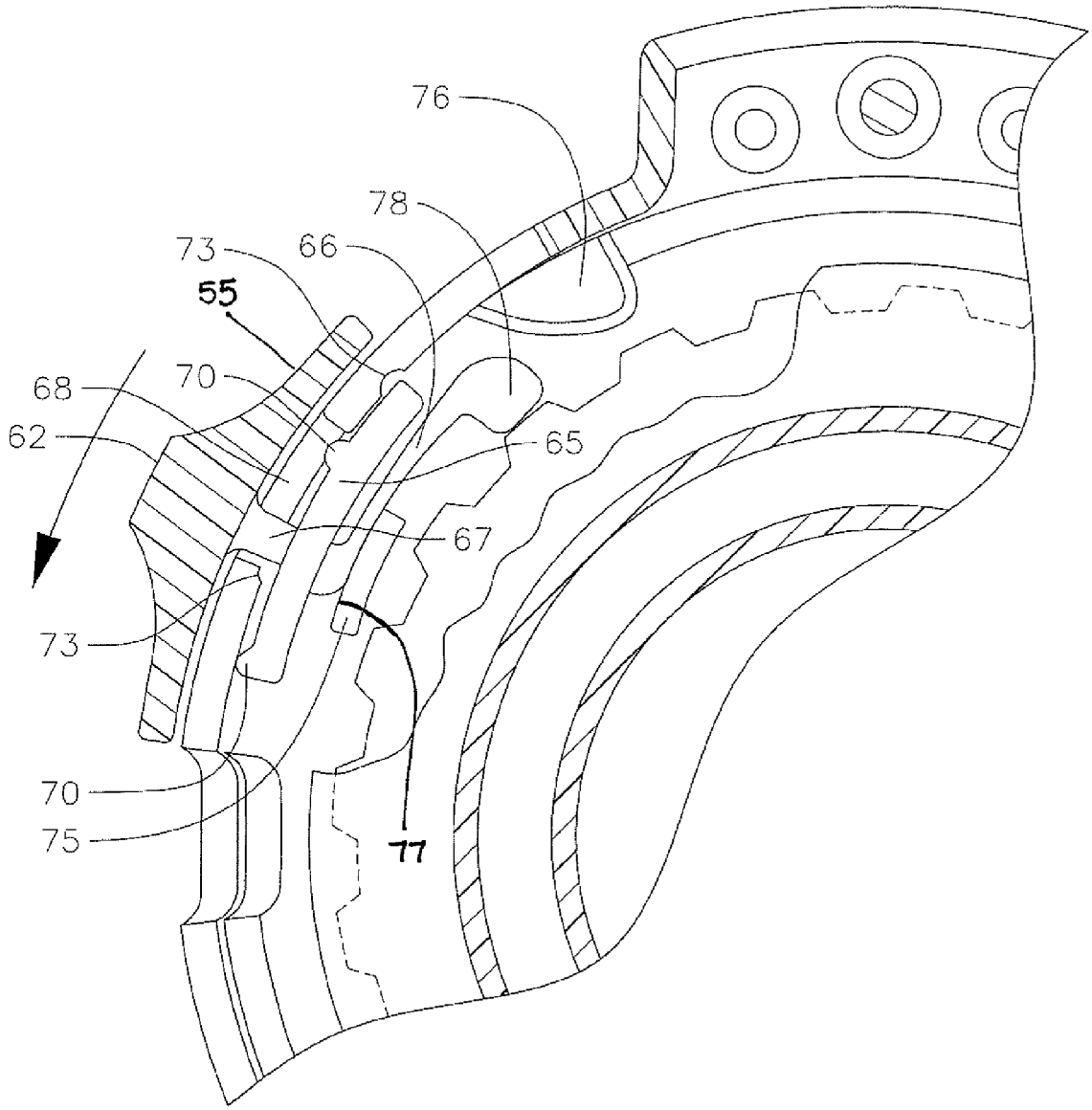
FIG. 4 is a cross-sectional view of the apparatus of FIG. 1, with a switch in a neutral position, taken long line A-A.
Figure 8:
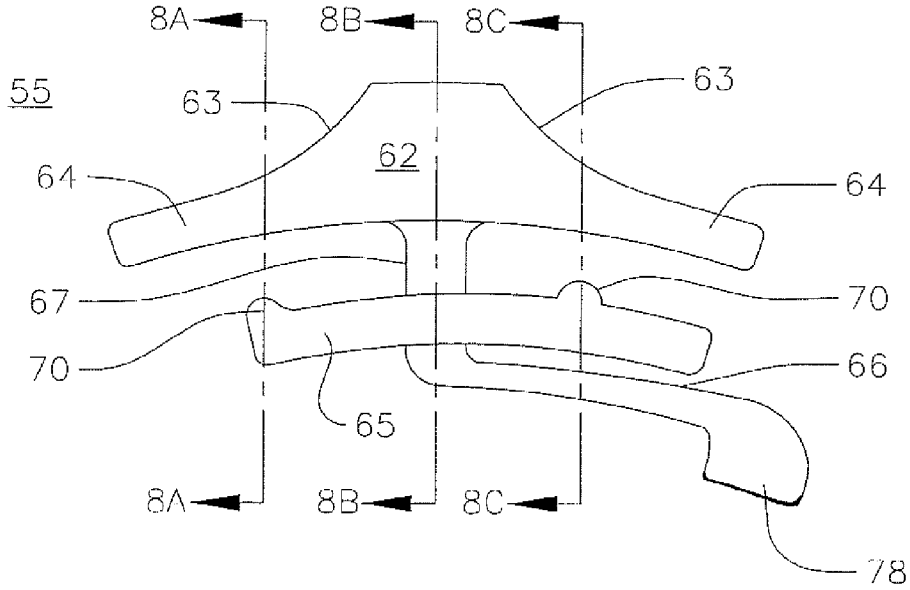
FIG. 8 is a side elevational view of an embodiment of a switch.
Figure 8A:
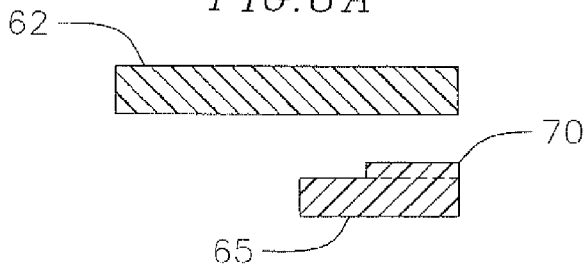
FIG. 8A is a cross-sectional view of the switch of FIG. 8, taken along line A-A.
Figure 8B:
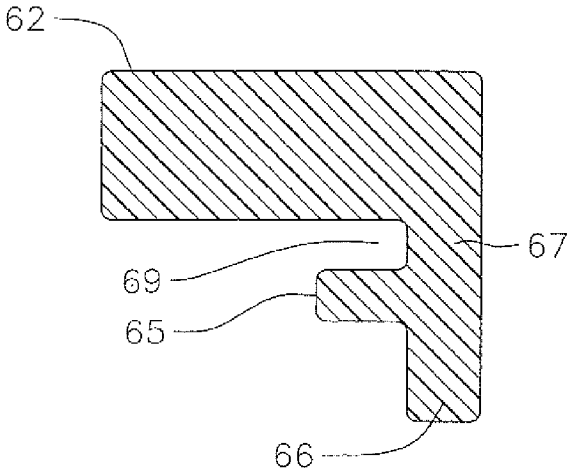
FIG. 8B is a cross-sectional view of the switch of FIG. 8, taken along line B-B.
Figure 8C:
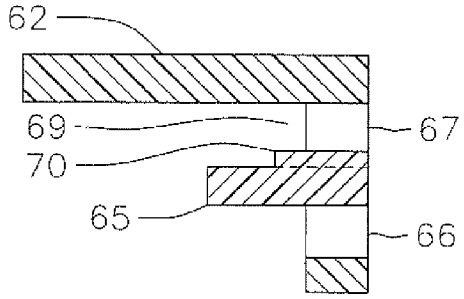
FIG. 8C is a cross-sectional view of the switch of FIG. 8, taken along line C-C.

The switch 55 of the retraction unit 12 allow a user to control rotation of the reel. The switch allows the reel to freely rotate or locks the reel against rotation in either direction. That is, the switch 55 is slidable between two positions for controlling the extension of the tensile member 20: a neutral position (FIG. 4) and a locking position (FIGS. 3A and 3B). As shown in the embodiment of FIG. 8, the switch 55 has an elongated body of a generally arcuate shape to correspond and conform with the circumference of the housing 30. The switch has an elongated outer user interface portion 62 with a friction inducing outer surface (e.g., a plurality of parallel ridges) between opposing thinner and curved end portions 64. The raised formation 63 is adapted for contact with a user's thumb or finger to slide the switch between the neutral and locking positions. The switch also has an inner elongated locking slider 65, a ratchet 66 extending inwardly from the slider, and a neck portion 67 connecting the interface portion 62 and the slider 65. The housing 30 is formed with an opening 68 (FIGS. 3A and 3B) through which the neck 67 extends with the switch 55 slidable but sandwiched between the first and second housing halves 30*a* and 30*b*. The interface portion 62 is exposed whereas the slider 65 and the ratchet 66 are inside the housing. The opening 68 in the housing is sufficiently elongated in the circumferential dimension to receive the neck 67 and allow sliding motion of the switch 55 in the circumferential direction between the neutral and locking positions. The interface portion 62 is sufficiently elongated in the circumferential dimension to cover the opening 68 with the switch being in either position. The slider 65 is also elongated in the circumferential direction. On an outwardly facing surface of the slider 65 are ridge formations 70 at each end of the slider. The ridge formations 70 are adapted for engagement with recesses 73 formed in the inner surface of the peripheral edge 31 of the first housing half 30*a* to releasably lock the switch 55 in the locking position (FIG. 3A).

In the embodiment of FIGS. 8, 8A-8C, the interface portion has the greatest length in the circumferential dimension, with the slider and the ratchet having lesser lengths. In the width dimension, the interface portion 62 has the greatest width, with the slider 65 having a lesser width and the ratchet 66 have the least width. As such, the interface portion 62 spans over both housing halves 30*a* and 30*b* whereas the slider 65 and the ratchet 66 reside primarily in the first housing half 30*a*. A gap 69 next to the neck 67 between the interface portion 62 and the slider 65 is mostly occupied by one of the peripheral projection 36 extending from the second housing half 30*b*. In the illustrated embodiment, the ridge formations 70 extend only about half the width of the slider 65.

Interacting with the ratchet 66 are a release cam 75 and a locking cam 76 formed as protrusions on the inner surface of the first housing half 30*a* projecting toward the second housing half 30*b*. The release cam 75 is situated near the switch 55 and is elongated with an outer-facing surface 77 generally following the curvature or circumference of the reel 42, which contacts an inner facing surface of the ratchet near the attached end of the ratchet. When the switch 55 is moved to the neutral position (in the counter-clockwise direction FIG. 4), the outer-facing surface 77 of the release cam 75 pushes the ratchet 66 outwardly so that an enlarged end 78 of the ratchet is free from contact with any cogs 54 so that the reel 42 can rotate in one direction under the force of the spring coil 47 or rotate in the other direction under the force of the user pulling and extending the tensile member 20. Notably, the ridge formations 70 on the slider 65 help push the ratchet 66 inwardly toward the release cam 75 in ensuring the enlarged end 78 is flexed away from the cogs 54.

The locking cam 76 is situated near enlarged end 78 and is of a generally triangular shape with a surface 91 that is angled relative to the circumferential direction. As the switch 55 is moved to the locking position (in the clockwise direction in FIG. 3A), the surface 91 of the locking cam 76 comes into contact with and pushes the enlarged end 78 inwardly to engage a cog 54 which locks the reel 42 against rotation in either direction.

The switch 55 can be made of any suitable material that is sufficiently rigid yet flexible and elastic to enable the ratchet 66 to releasably interact with the cams 75 and 76 and engage the reel 42. Plastics, such as acetal resins, are suitable materials.

Figure 5:
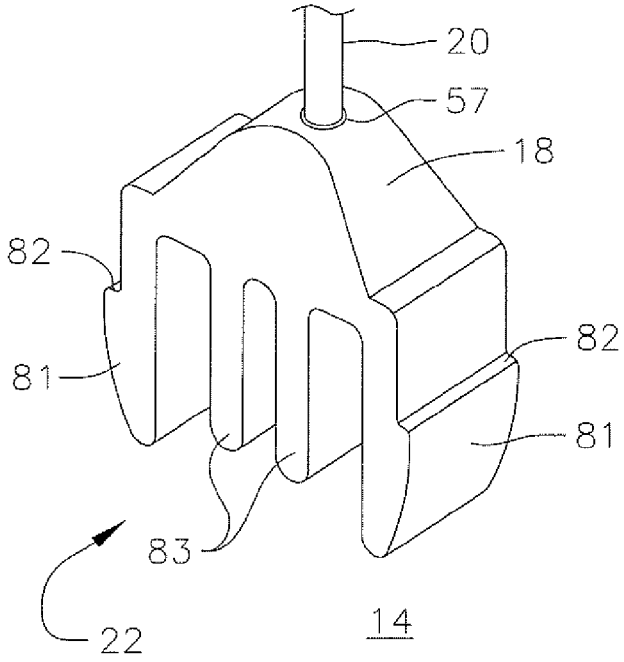
FIG. 5 is a perspective view of an embodiment of a connector.
Figure 6:
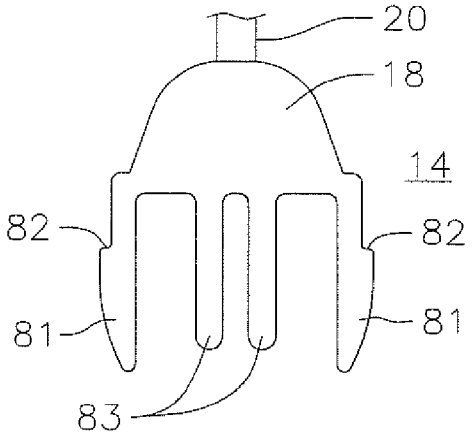
FIG. 6 is a front view of the connector of FIG. 5.
Figure 7:
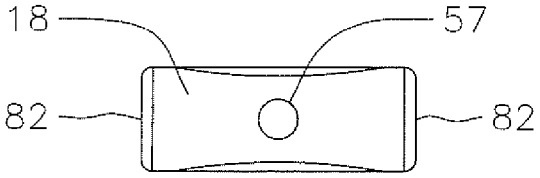
FIG. 7 is a top plan view of the connector of FIG. 5.
Figure 9:
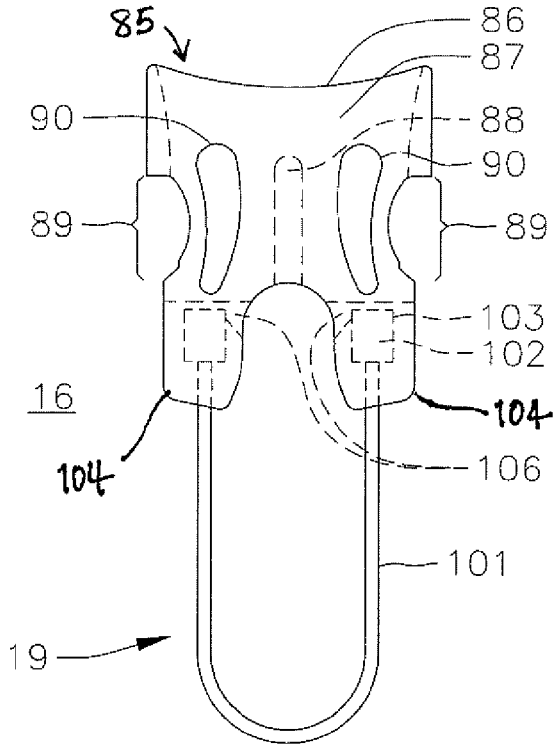
FIG. 9 is a front view of an embodiment of a fastener.

With reference to FIGS. 5 and 6, the connector 14 at the outer end of the tensile member 20 has a distal male portion 22. The proximal and distal portions 18 and 22 together present a generally planar profile that aligns with the planar profile of the retraction unit 12 when the connector is in the stored configuration (FIG. 2). The distal male portion 22 of the connector is adapted to be received in a proximal female portion 86 of the fastener 16 (FIG. 9). In the disclosed embodiment of FIGS. 5 and 6, the distal male portion 22 projects distally from the proximal male portion 18 and includes a pair of opposing outwardly facing elongated deformable prongs 81 (each with a catch protrusion 82). In between the two side prongs 81 are a plurality of elongated stop members 83 which lie coplanar with the prongs 81. As illustrated, the male portion 22 lies within a single plane, which plane tends to be also coplanar with the housing 30 when the connector 14 is nested in the receiving female cradle 40 of the housing 30 (FIG. 2). The elongated stop members or stop prongs 83 are parallel to the side prongs 81 and of generally equal length to the side prongs 81. The connector 14 can be made of any suitable material, for example, acetal resin materials, such as that sold under the trademark DELRIN®, that provides sufficient rigidity and elasticity to allow the side prongs 81 to be pressed inwardly toward each other so that they can be inserted into the fastener 16 and to allow the side prongs 81 to spring back so they lock within the fastener 16.

With reference to FIG. 9, the fastener 16 has a "pocket" body 85 with a generally planar profile that aligns with the connector 14 and the retraction unit 12 when the fastener 16 is engaged with the connector 14 in the stored configuration (FIG. 2). The body 85 has a proximal female portion 86 that defines an opening through which the male distal portion 22 of the connector 14 is inserted and received in an interior cavity 87 or pocket of the body. A planar divider 88 is provided in the interior cavity 87, and elongated side apertures 89 are formed in the body so that the side prongs 81 of the connector 14 can extend outwardly with the catch 82 latching a proximal end of the apertures 89. The side apertures 89 also allow a user access to the prongs 81. When a user squeezes the prongs 81 together, the connector 14 and the fastener 16 are released from each other. Additional aperture 90 are provided for material and weight reduction and aesthetic purposes. The fastener can be made of any suitable material with sufficient rigidity, for example, plastics such as polycarbonate.

A distal end of the fastener 16 includes the U-shaped dual connector 19 having an elongated or tensile member 101 (for example, a stainless steel cable) which forms a loop and whose two sides with ends are capped with fittings 102 that are releasably received in a pair of recesses 103 formed in opposing lateral extensions 104 of the body 85 immediately distal of the apertures 90. The member 101 lies in the plane of the body 85 and the apparatus 10 (FIG. 2). Fittings 102 have an interference fit (they fit snugly together) with the recesses 103. The interference fit between fittings 102 and the recesses 103 secures the two fittings 102 in the recesses 103 until the user pushes 101 axially to release at least one of the fittings from the recess, such as to hook or remove an item, such as a key. The recesses are blocked on the outside but have partially blocked angled openings 106 facing inwardly toward each other such that the user needs to push upward and proximally the side of the member 101 to be released so the fitting 102 clears the extension 104 and is released from the recess 103 via the opening 106. With one fitting released (FIG. 1C) or both fittings released (FIG. 1D), small tools or keys can be hung on or removed from the member 101. Advantageously, while the fastener 16 is coupled to the connector, 14, the fittings 102 are secured in the recesses 103 and not releasable from the fastener. That is, the ends of the stop prongs 83 of the connector 14 abuts the fittings 102 and prevent the fittings from being dislodged from the recesses 103. Thus, as a security feature, the member 101 can only be released from the fastener 16 while the fastener 16 is detached from the connector 14. In one embodiment, only one fitting is removable from the recess whereas the other fitting is fixed in the recess (FIG. 1C). In another embodiment, both fitting are removable from the recesses (FIG. 1D).

In accordance with a feature of the present invention, the connector 14 and/or the fastener 16 can adopt numerous configurations for different uses and applications, including (1) a joint stored configuration where both the connector and the fastener are in the stored configuration, attached and proximate the retraction unit (FIG. 1)

(2) a joint deployed configuration where both the connector and fastener are remote from the retraction unit but still attached to the retraction unit (FIG. 1A)

Figure 1D:
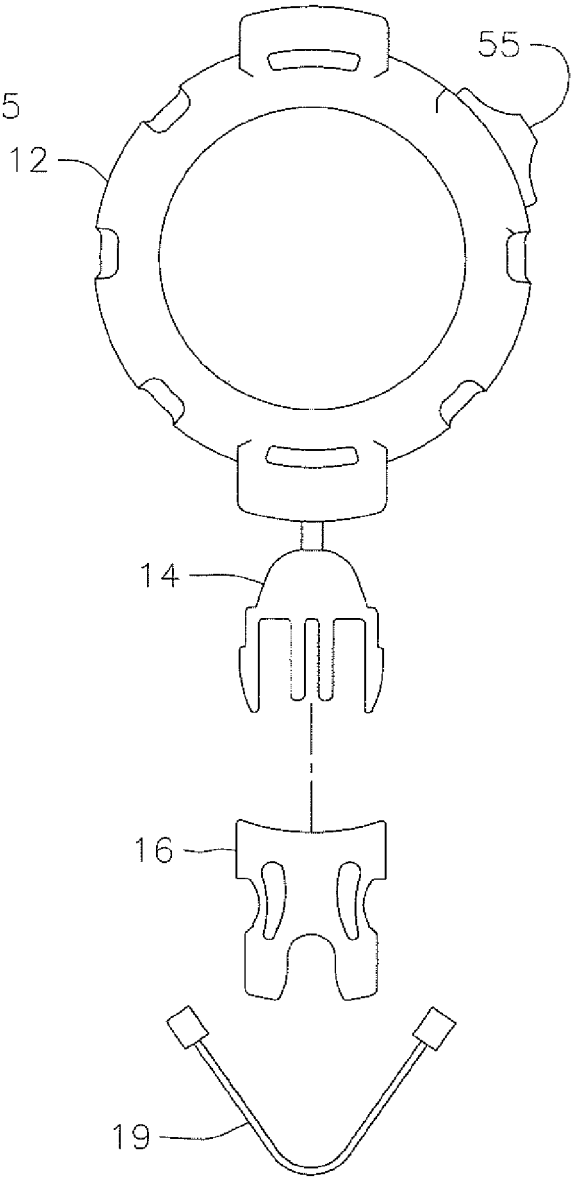
FIG. 1D is a front view of the apparatus of FIG. 1 with a connector in a deployed configuration, a fastener in a deployed/detached configuration and a dual connector in a detached configuration.

(3) a detached configuration where the fastener is separated from the connector and the retraction unit (FIGS. 1B, 1C and 1D) where the connector is either stored (FIG. 1C) or deployed relative to the retraction unit (FIGS. 1B and 1D).

Figure 10:
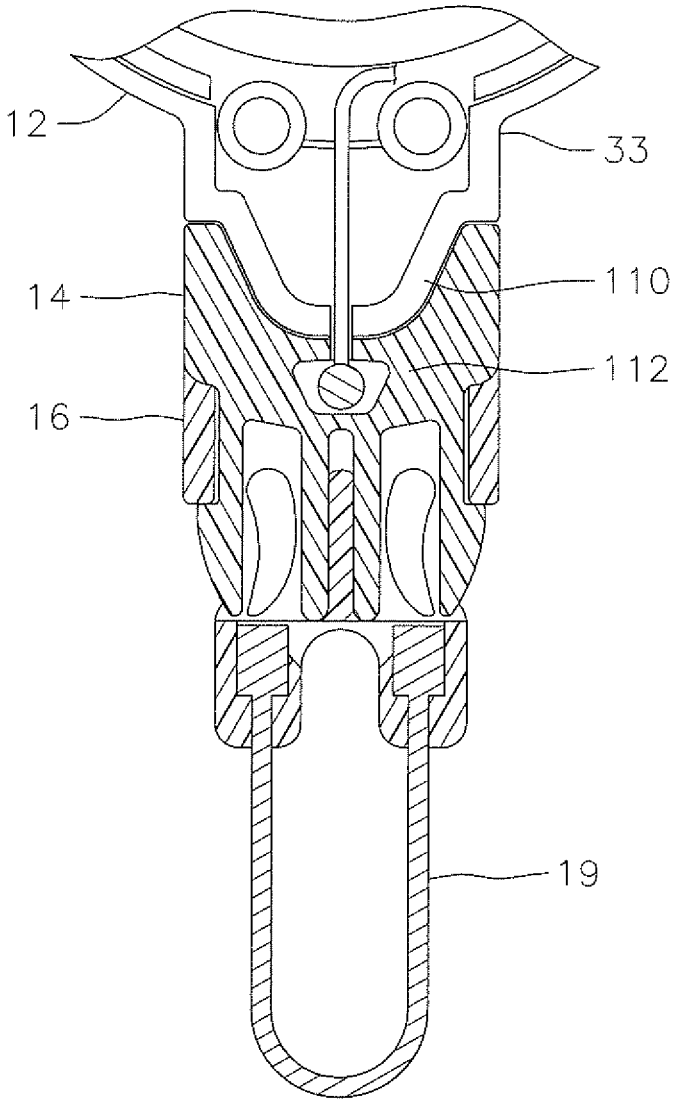
FIG. 10 is a cross-sectional view of an alternate embodiment of a connector and a fastener of the present invention.

In another alternate embodiment as shown in FIG. 10, the bottom portions 33 of each of the housing halves 30*a* and 30*b* jointly form a male formation 110 that is docked or fittingly received in a proximal female end 112 of the connector 14. It is understood by one of ordinary skill in the art that the interface between the retraction unit 12 and the connector 14 can be reversed to provide the same anti-swivel feature of the aforementioned embodiment. That is, the male formation 110 and the proximal female end 112 can be similarly wedge-shaped or tapered (e.g., trapezoidal), having a wider proximal lateral dimension and a narrower proximal lateral dimension, and both having a generally rectangular cross-section. Nested together, the male formation 110 and the female formation 112 secures the connector 14 to the retracting unit 12 in a manner that minimizes swivel motion of the connector 14 relative to the retracting unit 12. It is also understood by one of ordinary skill in the art that the interface between the connector 14 and the fastener 16 can also be reversed with the connector having a female distal end and the fastener having a distal end.

The preceding description has been presented with reference to certain exemplary embodiments of the invention. Workers skilled in the art and technology to which this invention pertains will appreciate that alterations and changes to the described structure may be practiced without meaningfully departing from the principal, spirit and scope of this invention. It is understood that the drawings are not necessarily to scale. Accordingly, the foregoing description should not be read as pertaining only to the precise structures described and illustrated in the accompanying drawings. Rather, it should be read as consistent with and as support for the following claims which are to have their fullest and fairest scope.

What is claimed is:

1. A portable releasable attachment apparatus adapted to carried by a person, comprising:

a retractable unit having a housing, a rotatable reel mounted inside the housing, a spring coil biasing rotation of the reel in one direction, and a tensile member carried on the reel, the tensile member having an inner end and an outer end, the housing having a formation through which the tensile member is adapted to extend outside of the housing;

a connector attached to the outer end of the tensile member, the connector having a distal end and a proximal end, the proximal end adapted for contact with the formation of the housing when the connector is in a stored configuration;

a fastener having a proximal end adapted for releasable attachment to the distal end of the connector, the fastener having a member adapted for carrying at least one item;

a switch mounted on the housing adapted to adopt a neutral position and a locking position, the switch having an integral ratchet member movable into and out of locking engagement with the reel in response to movement of the switch; and a locking cam fixedly coupled to an inner surface of the housing, wherein the locking cam is adapted to move the movable ratchet member into locking engagement with the reel.

2. An apparatus of claim 1, wherein the formation of the housing is a female opening and the proximal end of the connector is a male formation that is received in the female opening.

3. An apparatus of claim 1, wherein the formation of the housing is a male formation and the proximal end of the connector is a female formation that receives the male formation.

4. An apparatus of claim 2, wherein the proximal male end of the connector and the female opening of the housing limits lateral movement of the connector relative to housing when the connector is in the stored configuration.

5. An apparatus of claim 1, wherein the distal end of the connector includes a male formation and a proximal end of the fastener includes a female formation adapted to receive the male formation.

6. An apparatus of claim 1, wherein the housing includes a release cam adapted to move the movable member out of contact with the reel.

7. An apparatus of claim 1, wherein the fastener includes a U-shaped member having at least one end adapted for releasable engagement with the fastener.

8. An apparatus of claim 7, wherein the connector has at least one stop member adapted to abut a portion of the U-shaped member while the connector and fastener are attached to each other.

9. An apparatus of claim 5, wherein the distal male formation of the connector includes at least one prong adapted to latch with the fastener.

10. A portable releasable attachment apparatus adapted to be carried on a person's body, comprising:

a retractable unit having a housing, a rotatable reel mounted inside the housing, a spring coil biasing rotation of the reel in one direction, and a tensile member carried on the reel, the tensile member having an inner end and an outer end, the housing having a concave cradle and a female opening through which the tensile member is adapted to extend outside of the housing;

a connector member attached to the outer end of the tensile member, the connector having a distal end and a proximal male end, the proximal male end adapted to be nested in the concave cradle of the housing to limit lateral movement of the connector relative to housing when the connector is in a stored configuration;

a fastener member releasably attached to the connector; and a U-shaped member adapted for carrying at least one item and having at least one end adapted for releasable engagement with the fastener member, wherein the U-shaped member is releaseable from the fastener member only when the, fastener member is detached from the connector, wherein at least one member selected from the group consisting of the connector member and the fastener member is configured to adopt a stored configuration and a deployed configuration.

11. An apparatus of claim 10, wherein the housing includes a switch moveable between neutral position wherein the reel can rotate and a locking position wherein the reel is locked against rotation.

12. An apparatus of claim 11, wherein the housing has two housing halves between which the switch is movably sandwiched.

13. An apparatus of claim 11, wherein the switch is adapted to releasably lock with the housing in the neutral position and the locking position.

14. An apparatus of claim 11, wherein the switch includes an outer interface portion, an inner slider portion and an inner ratchet portion.

15. An apparatus of claim 10, wherein the proximal male end has a wedge-shape cross section.

16. An apparatus of claim 15, wherein the female opening has a wedge-shape cross section.

17. An apparatus of claim 10, wherein the member forms a loop.

18. An apparatus of claim 3, wherein the proximal female end of the connector and the male formation of the housing limits lateral movement of the connector relative to housing when the connector is in the stored configuration.

19. An apparatus of claim 10, wherein the connector has at least one stop member adapted to abut a portion of the U-shaped member while the connector and the fastener member are attached to each other.

20. An apparatus of claim 10, wherein the U-shaped member comprises a tensile member and a pair of fittings attached to opposite ends of the tensile member.

* * * * *

UNITED STATES PATENT AND TRADEMARK OFFICE

CERTIFICATE OF CORRECTION

PATENT NO. : 8,746,519 B2
APPLICATION NO. : 12/688704
DATED : June 10, 2014
INVENTOR(S) : Stanfield Young et al.

It is certified that error appears in the above-identified patent and that said Letters Patent is hereby corrected as shown below:

In the Claims

| | |
|---|---|
| Col. 7, line 63, Claim 1 | Delete "to carried",<br>Insert --to be carried-- |
| Col. 9, line 5, Claim 10 | Delete "the, fastener",<br>Insert --the fastener-- |

Signed and Sealed this
Second Day of August, 2016

Michelle K. Lee

Michelle K. Lee
*Director of the United States Patent and Trademark Office*